US006472113B2

(12) United States Patent
Hamaguchi et al.

(10) Patent No.: US 6,472,113 B2
(45) Date of Patent: Oct. 29, 2002

(54) ELECTROPHOTORECEPTOR, IMAGE FORMING APPARATUS AND PROCESSING CARTRIDGE

(75) Inventors: Shinichi Hamaguchi; Hirohumi Hayata, both of Hino (JP)

(73) Assignee: Konica Corporation, Konica ( * ) Notice: Subject to any disclaimer, the term of this patent is extended or adjusted under 35 U.S.C. 154(b) by 0 days.

(21) Appl. No.: 09/835,735

(22) Filed: Apr. 16, 2001

(65) Prior Publication Data

US 2001/0044063 A1 Nov. 22, 2001

(30) Foreign Application Priority Data

Apr. 18, 2000 (JP) ..... 2000-116411

(51) Int. Cl.[7] ..... G03G 5/047
(52) U.S. Cl. ..... 430/65; 430/131
(58) Field of Search ..... 430/63, 65, 131

(56) References Cited

U.S. PATENT DOCUMENTS 5,612,158 A * 3/1997 Iguchi et al. ..... 430/65
5,958,638 A * 9/1999 Katayama et al. ..... 430/65
6,136,484 A * 10/2000 Katayama et al. ..... 430/63
6,177,219 B1 * 1/2001 Yuh et al. ..... 430/65
6,214,506 B1 * 4/2001 Kurihara et al. ..... 430/65
6,225,014 B1 * 5/2001 Patterson et al. ..... 430/64

FOREIGN PATENT DOCUMENTS

JP 4229872 A * 8/1992

OTHER PUBLICATIONS

Derwent Acc. No. 1991–326603 (1992).*

* cited by examiner

*Primary Examiner*—Christopher Rodee
(74) *Attorney, Agent, or Firm*—Bierman, Muserlian and Lucus

(57) ABSTRACT

An electrophotoreceptor, comprises a conductive support; a photoreceptive layer, an intermediate layer provided between the conductive support and the photoreceptive layer, the intermediate layer containing N type semi-conductive fine particles and a binder resin, wherein the N type semi-conductive fine particles are subjected to plural surface treatments, and the final surface treatment is carried out employing a reactive organic silicon compound.

5 Claims, 1 Drawing Sheet

ELECTROPHOTORECEPTOR, IMAGE FORMING APPARATUS AND PROCESSING CARTRIDGE

BACKGROUND OF THE INVENTION

The present invention relates to an electrophotoreceptor used in the field of copiers or printers, and to an image forming apparatus and processing cartridge employing the electrophotoreceptor.

The photoreceptor for electrophotography shifts its use from inorganic photoreceptors such as Se, arsenic, arsenic/Se alloy, CdS and ZnO, to organic photoreceptors which are advantageous in terms of reduced public pollution as well as in ease of their manufacture, and various organic photoreceptors have been developed.

Recently, function-separated type photoreceptors have predominated in which a charge generating function and a charge transporting function are separately assigned to different materials. Of these, multi-layered type photoreceptors in which a charge generating layer and a charge transporting layer are separately coated are widely used.

Latent image forming methods in electrophotographic processes are divided into two methods, one being an analog latent image forming method employing a halogen lamp as a light source, and the other being a digital latent image forming method employing LED or a laser as a light source. Recently, the digital latent image forming method rapidly predominates in its application to printers for hard copy of a personal computer or in conventional copiers, on account of its ease of image processing or application to other hybrid apparatuses.

In the digital image forming method, a light source used, when image information converted to digital electric signal is written on the photoreceptor as a latent image, is a laser, and particularly a semi-conductor laser or LED. However, in forming a latent image according to laser light, there is a specific imaging problem in that interference fringes are produced due to reflection of light from a photoreceptor support.

Further, writing according to the digital image forming method is mainly used in combination with a reversal developing method developing exposed portions, since exposing beam spot diameter is small, and therefore, writing speed is low. However, there is a problem specific to the image forming method employing this reversal development that toner adheres to white backgrounds free from no image, resulting in fogging, that is, black spots are produced due to local defects of the photoreceptors.

In order to solve these problems, techniques employing an intermediate layer has been developed. For example, the electrophotoreceptor is known which comprises, between a conductive support and a photoreceptive layer, an intermediate layer containing titanium oxide particles dispersed in a resin. Further, technique employing an intermediate layer containing surface-treated titanium oxide is known. For example, there are mentioned of titanium oxide surface-treated with iron oxide or tungsten oxide as described in Japanese Patent O.P.I. Publication No. 4-303846, titanium oxide surface-treated with an amino group-containing coupling agent as described in Japanese Patent O.P.I. Publication No. 9-96916, titanium oxide surface-treated with an organic silicon compound as described in Japanese Patent O.P.I. Publication No. 9-258469, and titanium oxide surface-treated with methyl hydrogen polysiloxane as described in Japanese Patent O.P.I. Publication No. 8-328283.

However, these techniques have still problems that black spot occurrence is not sufficiently restrained when used under severe conditions such as high temperature and high humidity or low temperature and low humidity, potential at exposed portions or residual potential increases at repeated runs, or sufficient image density is not obtained. There is a proposal in Japanese Patent O.P.I. Publication No. 11-344826 of an electrophotoreceptor comprising an intermediate layer containing dentritic titanium oxide surface-treated with metal oxides or organic compounds. However, in the tests carried out according to the examples disclosed in this patent, black spot occurrence was not sufficiently restrained when used under severe conditions such as high temperature and high humidity or low temperature and low humidity.

SUMMARY OF THE INVENTION

In view of the above problems in the state of the art, an object of the present invention is to provide an electrophotoreceptor with good potential stability which does not produce defects such as black spots, and particularly an electrophotoreceptor having an intermediate layer which does not produce defects such as black spots, and provides good potential stability at repeated use. Further, another object of the present invention is to provide an image forming apparatus and a processing cartridge employing the electrophotoreceptor.

The above object of the invention could be attained by any one of the following constitutions:

1. An electrophotoreceptor comprising, between a support and a photoreceptive layer, an intermediate layer containing N type semi-conductive fine particles and a binder resin, wherein the N type semi-conductive fine particles are subjected to plural surface treatments, and the final surface treatment is carried out employing a reactive organic silicon compound.
2. The electrophotoreceptor described in item 1 above, wherein the final surface treatment is carried out employing methyl hydrogen polysiloxane.
3. The electrophotoreceptor described in item 1 above, wherein the final surface treatment is carried out employing a reactive organic silicon compound represented by the following formula (1):

$$R—Si—X_3 \qquad \text{formula (1)}$$

wherein R represents an alkyl group or an aryl group, and X represents a methoxy group, an ethoxy group or a halogen atom.

4. The electrophotoreceptor described in item 1 or 3 above, wherein R represents an alkyl group having a carbon atom number of 4 to 8.
5. An electrophotoreceptor comprising, between a support and a photoreceptive layer, an intermediate layer containing N type semi-conductive fine particles and a binder resin, wherein the N type semi-conductive fine particles are subjected to plural surface treatments, and the final surface treatment is carried out employing a reactive organic titanium compound.
6. An electrophotoreceptor comprising, between a support and a photoreceptive layer, an intermediate layer containing N type semi-conductive fine particles and a binder resin, wherein the N type semi-conductive fine particles are subjected to plural surface treatments, and the final surface treatment is carried out employing a reactive organic zirconium compound.

7. The electrophotoreceptor described in any one of items 1 through 6 above, wherein at least one of the plural surface treatments is carried out employing at least one of alumina, silica and zirconia.
8. The electrophotoreceptor described in any one of items 1 through 4 and item 7 above, wherein the N type semi-conductive fine particles are surface treated with silica, alumina, followed by surface treatment with a reactive organic silicon compound.
9. The electrophotoreceptor described in item 5 or 7 above, wherein the N type semi-conductive fine particles are surface treated with silica, alumina, followed by surface treatment with a reactive organic titanium compound.
10. The electrophotoreceptor described in item 6 or 7 above, wherein the N type semi-conductive fine particles are surface treated with silica, alumina, followed by surface treatment with a reactive organic zirconium compound.
11. The electrophotoreceptor described in any one of items 1 through 10 above, wherein the N type semi-conductive fine particles are titanium oxide particles.
12. The electrophotoreceptor described in any one of items 1 through 11 above, wherein the N type semi-conductive fine particles have a crystal structure of rutile type.
13. An electrophotoreceptor comprising, between a support and a photoreceptive layer, an intermediate layer containing at least titanium oxide particles and a binder resin, wherein the titanium oxide particles are surface-treated employing a fluorine-containing organic silicon compound.
14. The electrophotoreceptor described in any one of items 1 through 13 above, wherein the binder resin in the intermediate layer is polyamide resin.
15. The electrophotoreceptor described in any one of items 1 through 12 and item 14 above, wherein the N type semi-conductive fine particles have a number average primary order particle size of 10 to 200 nm.
16. The electrophotoreceptor described in item 13 or 14, wherein the titanium oxide particles have a number average primary order particle size of 10 to 200 nm.
17. A method of manufacturing the electrophotoreceptor as described in any one of items 1 through 12, and items 14 and 15 above, wherein the method comprises the step of coating on a support an intermediate layer coating solution containing the N type semi-conductive fine particles, the binder resin and a mixture solvent comprised of two or more kinds of alcohols to form an intermediate layer.
18. A method of manufacturing the electrophotoreceptor as described in any one of items 13, 14 and 16 above, wherein the method comprises the step of coating on a support an intermediate layer coating solution containing the titanium oxide particles, the binder resin and a mixture solvent comprised of two or more kinds of alcohols to form an intermediate layer.
19. An image forming apparatus comprising at least a charging means, an exposing means, a developing means, a transferring means and a cleaning means at the vicinity of an electrophotoreceptor, and repeatedly forming an image, wherein the electrophotoreceptor is one described in any one of items 1 through 16 above.
20. A processing cartridge used in an image forming apparatus comprising at least a charging means, an exposing means, a developing means, a transferring means, and a cleaning means at the vicinity of an electrophotoreceptor, and repeatedly forming an image, wherein the processing cartridge comprises the electrophotoreceptor as described in any one of items 1 through 16 above being integrated with at least one of the charging means, exposing means, developing means, transferring means and cleaning means, and is capable of being mounted on the image forming apparatus and dismounted.

DETAILED DESCRIPTION OF THE INVENTION

Figure 1:
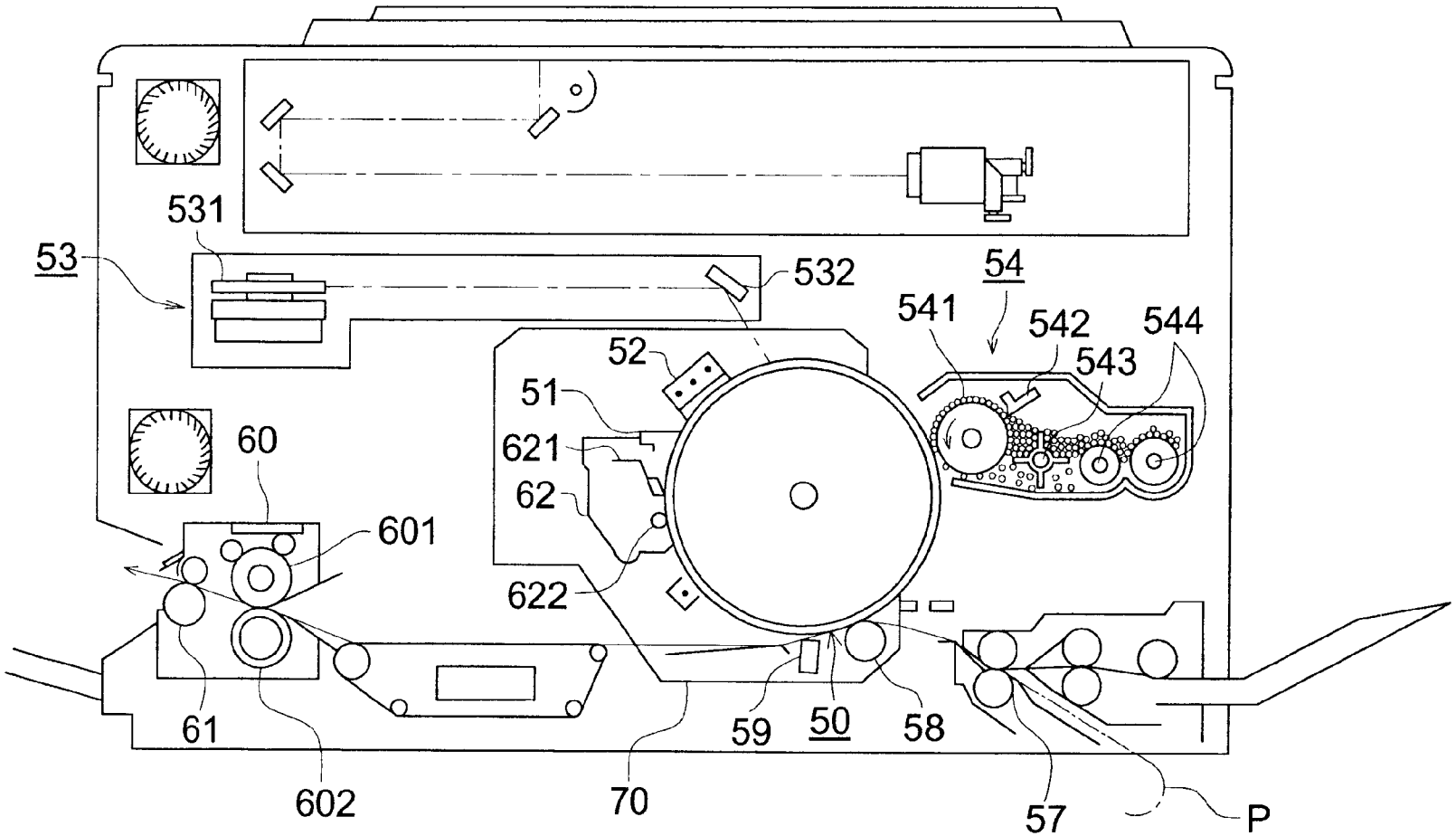
FIG. 1 shows a sectional view of one embodiment of the image forming apparatus according to image forming method of the invention.

Next, the invention will be explained in detail.

The electrophotoreceptor (hereinafter referred to also as photoreceptor) of the invention is characterized in that the electrophotoreceptor comprises, between a conductive support and a photoreceptive layer, an intermediate layer containing N type semi-conductive fine particles subjected to specific surface treatments and a binder resin. The surface treatment is characterized in that (1) the N type semi-conductive fine particles are subjected to plural surface treatments, and the final surface treatment is carried out employing a reactive organic silicon compound; (2) the N type semi-conductive fine particles are surface-treated employing a fluorine-containing organic silicon compound; (3) the N type semi-conductive fine particles are subjected to plural surface treatments, and the final surface treatment is carried out employing a reactive organic titanium compound; or (4) the N type semi-conductive fine particles are subjected to plural surface treatments, and the final surface treatment is carried out employing a reactive organic zirconium compound.

It has been found that deterioration of electrophotographic properties such as increase of residual potential or decrease of charging potential can be prevented, black spot occurrence can be markedly restrained, and moire occurrence resulting from laser exposure can be minimized by providing, between a conductive support and a photoreceptive layer, an intermediate layer containing the N type semi-conductive fine particles surface-treated according to one of the above four surface treatments.

In the invention, it has been found that titanium oxide fine particles are especially preferably used as the N type semi-conductive fine particles.

Next, the N type semi-conductive fine particles and titanium oxide used in the invention and the surface treatments described above will be explained in detail.

The N type semi-conductive fine particles used in the invention refer to fine particles having a property in which conductive carrier is an electron. The property in which conductive carrier is an electron is a property that the N type semi-conductive fine particles, when contained in an insulating binder, efficiently block incorporation of holes from a support, and do not block incorporation of electrons from a photoreceptive layer.

Examples of the N type semi-conductive fine particles include fine particles of titanium oxide ($TiO_2$), zinc oxide ($ZnO_2$), and tin oxide ($SnO_2$). In the invention, titanium oxide is preferably used.

With respect to the average particle size of the N type semi-conductive fine particles used in the invention, the N type semi-conductive fine particles have a number average primary order particle size of preferably 10 to 200 nm, more preferably 10 to 100 nm, and most preferably 15 to 50 nm.

A coating solution for forming an intermediate layer, containing the N type semi-conductive fine particles having the number average primary order particle size falling within the range described above, has good dispersion stability. Further, the intermediate layer formed from such a coating solution provides a sufficient potential stability and restrains black spot occurrence.

The number average primary order particle size of the N type semi-conductive fine particles described above is obtained by the following. For example, the titanium oxide particles are magnified by a factor of 10,000 according to a transmission electron microscope, and one hundred particles are randomly selected as primary order particles from the magnified particles, and are obtained by measuring an average value of the Feret diameter according to image analysis.

As the N type semi-conductive fine particles used in the invention there are N type semi-conductive fine particles in the dendritic, acicular or granular form. With respect to a crystal structure of such N type semi-conductive fine particles, for example, crystal structures of the titanium oxide include a crystal structure of anatase type, rutile type or amorphous type. Any type crystal structure or a mixture of two or more kinds of crystal structures can be used in the invention.

In the invention, one of the surface treatments of the N type semi-conductive fine particles is that the N type semi-conductive fine particles are subjected to plural surface treatments and the final surface treatment is carried out employing a reactive organic silicon compound. It is preferred that at least one of the plural surface treatments is carried out employing at least one of alumina, silica and zirconia, and the final surface treatment is carried out employing a reactive organic silicon compound. The surface treatment with alumina, silica or zirconia described later refers to surface treatment precipitating alumina, silica or zirconia on the surface of the N type semi-conductive fine particles. The alumina, silica and zirconia precipitated on the surface also include their hydrates. The surface treatment with a reactive organic silicon compound refers to treatment employing the reactive organic silicon compound in a solution for surface treatment.

In the invention, another of the surface treatments of the N type semi-conductive fine particles is that the N type semi-conductive fine particles are subjected to plural surface treatments and the final surface treatment is carried out employing a reactive organic titanium compound or a reactive organic zirconium compound. It is preferred that at least one of the plural surface treatments is carried out employing at least one of alumina, silica and zirconia, and the final surface treatment is carried out employing a reactive organic titanium compound or a reactive organic zirconium compound.

Coverage of the surface of the N type semi-conductive fine particles such as the titanium oxide particles subjected to at least two surface treatments is uniform, and an intermediate layer containing the resulting N type semi-conductive fine particles can provide an intermediate layer with good dispersion stability, and a photoreceptor which does not produce image defects such as black spots.

The plural surface treatments are preferably surface treatments comprising plural surface treatments with silica, alumina, followed by surface treatment with an reactive organic silicon compound, or surface treatments comprising surface treatment with a reactive organic titanium compound or a reactive organic zirconium compound after surface treatment with alumina, silica.

The surface treatment with alumina, silica may be carried out simultaneously. It is preferred that the surface treatment is carried out firstly with alumina, and secondly with silica. When the surface treatment is carried out with alumina and silica, the amount used of silica is preferably more than that of alumina. The surface treatment of the N type semi-conductive fine particles employing metal oxides such as alumina, silica and zirconia can be carried out employing a wet process. For example, the N type semi-conductive fine particles surface-treated with silica or alumina can be prepared as follows:

When titanium oxide particles are used as the N type semi-conductive fine particles, titanium oxide particles (a number average primary order particle size of 50 nm) are dispersed in water in a concentration of 50 to 350 g/L to obtain an aqueous slurry, and a water soluble silicate or a water soluble aluminum compound is added to the slurry. The resulting dispersion is neutralized with an alkali or an acid to precipitate silica or alumina on the surface of the titanium oxide particles, filtered, washed and dried. Thus, surface-treated titanium oxide particles are obtained. When sodium silicate is used as the water soluble silicate, the neutralization is carried out employing an acid such as sulfuric acid, nitric acid or hydrochloric acid. When aluminum sulfate is used as the water soluble aluminum compound, the neutralization is carried out employing an alkali acid such as sodium hydroxide or potassium hydroxide.

When the N type semi-conductive fine particles are surface-treated with metal oxides, the amount used of the metal oxides is preferably 0.1 to 50 weight parts, and more preferably 1 to 10 weight parts, based on 100 weight parts of the N type semi-conductive fine particles such as the titanium oxide particles. When the titanium oxide particles are surface-treated with silica and alumina, the silica and alumina are used in an amount of preferably 1 to 10 weight parts based on 100 weight parts of the titanium oxide particles, respectively.

The surface treatment employing a reactive organic silicon compound, which follows the above surface treatment employing metal oxides, is preferably carried out employing a wet process as described below.

The metal oxide surface-treated titanium oxide particles as described above are added to a solution or dispersion, in which the reactive organic silicon compound as described above has been dissolved or dispersed in water or an organic solvent, mixed while stirring for several minutes to several hours, optionally heated, filtered and dried to obtain titanium oxide particles the surface of which is covered with the reactive silicon compound. The reactive silicon compound can be also added to a dispersion in which titanium oxide particles are dispersed in water or an organic solvent.

The reactive organic silicon compound, with which the titanium oxide surface has been covered, can be confirmed employing a surface analyzing method such as photoelectron spectroscopy (ESCA), Auger electron spectroscopy (Auger), secondary ion mass spectroscopy (SIMS) or diffusion reflection FI-IR.

When the titanium oxide particles are surface-treated with the reactive organic silicon compound, the amount used of the reactive organic silicon compound is preferably 0.1 to 50 weight parts, and more preferably 1 to 10 weight parts, based on 100 weight parts of the titanium oxide particles having been surface-treated with the metal oxides. The amount less than the above range does not produce satisfactory surface treatment effects, resulting in lowering of dispersibility of the titanium oxide particles in the intermediate layer. The amount exceeding the above range lowers electric properties, resulting the residual potential increase and charging potential lowering. The reactive silicon compound used in the invention is preferably a compound represented by the following formula (2). However, the reactive silicon compound is not limited thereto, as long as it is a compound capable of condensing with a reactive group such as a hydroxy group on the surface of the titanium oxide particles.

$$(R)_n—Si—(X)_{4-n} \quad \text{formula (2)}$$

wherein Si represents a silicon atom, R represents an organic group whose carbon atom bonds directly to the silicon atom, X represents a hydrolyzable group, and n represents an integer of 0 to 3.

In the organic silicon compound represented by formula (2), the organic group represented by R, whose carbon atom bonds directly to the silicon atom, is an alkyl group such as methyl, ethyl, propyl, butyl, pentyl, hexyl, octyl or dodecyl, an aryl group such as phenyl, tolyl, naphthyl or biphenyl, an epoxy-containing group such as γ-glycidoxypropyl or β-(3,4-epoxycyclohexyl)ethyl, a (meth)acryloyl-containing group such as γ-acryloxypropyl or γ-methacryloxypropyl, a hydroxy-containing group such as γ-hydroxypropyl or 2,3-dihydroxypropyloxypropyl, a vinyl-containing group such as vinyl or propenyl, a mercapto-containing group such as γ-mercaptopropyl, an amino-containing group such as γ-aminopropyl or N-β-(aminoethyl)-γ-aminopropyl, a halogen-containing group such as γ-chloropropyl, 1,1,1-trifluoropropyl, nonafluorohexyl or perfluorooctylethyl, a nitro group or a cyano group. The alkyl group such as methyl, ethyl, propyl or butyl is especially preferable. The hydrolyzable group represented by X is preferably an alkoxy group such as methoxy or ethoxy, a halogen group or an acyloxy group. The hydrolyzable group is especially preferably an alkoxy group having a carbon atom number of not more than 6.

The organic silicon compound represented by formula (2) may be used singly or in combination of two or more kinds.

In the organic silicon compound represented by formula (2), when n is 2 or more, plural R's may be the same or different, and when n is 2 or less, plural X's may be the same or different. When two or more kinds of the organic silicon compounds represented by formula (2) are used, R and X may be the same of different in each compound.

When n is 0, examples of the organic silicon compounds include the following compounds: tetrachlorosilane, diethoxydichlorosilane, tetramethoxysilane, phenoxytrichlorosilane, tetraacetoxysilane, tetraethoxysilane, tetraallyloxysilane, tetrapropoxysilane, tetraisopropoxysilane, tetrakis(2-methoxyethoxy)silane, tetralbutoxysilane, tetraphenoxysilane, tetrakis(2-ethylbutoxy)silane, and tetrakis(2-ethylhexyloxy) silane.

When n is 1, examples of the organic silicon compounds include the following compounds: trichlorosilane, methyltrichlorosilane, vinyltrichlorosilane, ethyltrichlorosilane, allyltrichlorosilane, n-propyltrichlorosilane, n-butyltrichlorosilane, chloromethyltrichlorosilane, methyltrimethoxysilane, mercaptomethyltrimethoxysilane, trimethoxyvinylsilane, ethyltrimethoxysilane, 3,3,4,4,5,5,6,6,6-nonafluorohexyltrichlorosilane, phenyltrichlorosilane, 3,3,3-trifluoropropyltrimethoxysilane, 3-chloropropyltrimethoxysilane, triethoxysilane, 3-mercaptopropyltrimethoxysilane, 3-aminopropyltrimethoxysilane, 2-aminoethylaminomethyltrimethoxysilane, benzyltrichlorosilane, methyltriacetoxysilane, chloromethyltriethoxysilane, ethyltriacetoxysilane, phenyltrimethoxysilane, 3-allylthiopropyltrimethoxysilane, 3-glycidoxypropyltrimethoxysilane, 3-bromopropyltriethoxysilane, 3-allylaminopropyltrimethoxysilane, propyltriethoxysilane, hexyltrimethoxysilane, 3-aminopropyltriethoxysilane, 3-methacryloxypropyltrimethoxysilane, bis(ethylmethylketoxime)methoxymethylsilane, pentyltriethoxysilane, octyltriethoxysilane, and dodecyltriethoxysilane.

When n is 2, examples of the organic silicon compounds include the following compounds: dimethyldichlorosilane, dimethoxymethylsilane, dimethoxydimethylsilane, methyl-3,3,3-trifluoropropyldichlorosilane, diethoxysilane, diethoxymethylsilane, dimethoxymethyl-3,3,3-trifluoropropylsilane, 3-chloropropyldimethoxymethylsilane, chloromethyldiethoxysilane, diethoxydimethylsilane, dimethoxy-3-mercaptopropylmethylsilane, 3,3,4,4,5,5,6,6,6-nonafluorohexyldichlorosilane, methylphenyldichlorosilane, diacetoxymethylvinylsilane, diethoxymethylvinylsilane, 3-methacryloxypropylmethyldichlorosilane, 3-aminopropyldiethoxymethylsilane, 3-(2-aminoethylaminopropyl)dimethoxymethylsilane, t-butylphenyldichlorosilane, 3-methacryloxypropyldimethoxymethylsilane, 3-(3-cyanopropylthiopropyl)dimethoxymethylsilane, 3-(2-acetoxyethylthiopropyl)dimethoxymethylsilane, dimethoxymethy-2-piperidinoethylsilane, dibutoxydimethylsilane, 3-dimethylaminopropyldiethoxymethylsilane, diethoxymethylphenylsilane, diethoxy-3-glycidoxypropylmethylsilane, 3-(3-acetoxypropylthio)propyldimethoxymethylsilane, dimethoxymethyl-3-piperidinopropylsilane, and diethoxymethyloctadecylsilane.

When n is 3, examples of the organic silicon compounds include the following compounds: trimethylchlorosilane, methoxytrimethylsilane, ethoxytrimethylsilane, methoxydimethyl-3,3,3-trifluoropropylsilane, 3-chloropropylmethoxydimethylsilane, and methoxy-3-mercaptopropylmethylethylsilane.

The organic silicon compound represented by formula (2) is preferably an organic silicon compound represented by the following formula (1):

$$R—Si—X_3 \quad \text{formula (1)}$$

wherein R represents an alkyl group or an aryl group, and X represents a methoxy group, an ethoxy group or a halogen atom.

The organic silicon compound represented by formula (1) is preferably an organic silicon compound wherein in formula (1), R is an alkyl group having a carbon atom number of 4 to 8. Preferred examples of the organic silicon compound represented by formula (1) include trimethoxybutylsilane, trimethoxyisobutylsilane, trimethoxyhexylsilane, and trimethoxyoctylsilane.

The preferred reactive organic silicon compounds used at the final surface treatment are polysiloxane compounds. As such polysiloxane compounds, polysiloxane compounds having a molecular weight of 1000 to 2000 are available on the market, and effectively restrain black spot occurrence. Particularly, use of methyl hydrogen polysiloxane at the final surface treatment provides good results.

In the invention, another one of the surface treatments of titanium oxide particles is carried out employing fluorine-containing silicon compounds. The surface treatment, employing the fluorine-containing organic silicon compounds, is preferably carried out by a wet process as described above.

That is, non-treated titanium oxide particles are added to a solution or dispersion, in which the fluorine-containing organic silicon compound as described above has been dissolved or dispersed in water or an organic solvent, mixed while stirring for several minutes to several hours, optionally heated, filtered and dried to obtain titanium oxide particles the surface of which is covered with the fluorine-containing silicon compound. The fluorine-containing organic silicon compound can be also added to a dispersion in which titanium oxide particles are dispersed in water or an organic solvent.

The fluorine-containing organic silicon compound, with which the titanium oxide surface is covered, can be confirmed employing a surface analyzing method such as photoelectron spectroscopy (ESCA), Auger electron spectroscopy (Auger), secondary ion mass spectroscopy (SIMS) or diffusion reflection FI-IR.

Examples of the fluorine-containing organic silicon compounds used in the invention include 3,3,4,4,5,5,6,6,6-nonafluorohexyltrichlorosilane, 3,3,3-trifluoropropyltrimethoxysilane, methyl-3,3,3-trifluoropropyldichlorosilane, dimethoxymethyl-3,3,3-trifluoropropylsilane and 3,3,4,4,5,5,6,6,6-nonafluorohexylmethyldichlorosilane.

In the invention, the final surface treatments, which the N type semi-conductive fine particles as described above are subjected to, include those carried out employing a reactive organic titanium compound or a reactive organic zirconium compound. Typically, the final surface treatment is carried out by a method according to a surface treatment employing the reactive organic silicon compound as described above.

The reactive organic titanium compound or a reactive organic zirconium compound, with which the N type semi-conductive fine particle surface is covered, can be confirmed in detail employing a surface analyzing method such as photoelectron spectroscopy (ESCA), Auger electron spectroscopy (Auger), secondary ion mass spectroscopy (SIMS) or diffusion reflection FI-IR.

Examples of the reactive organic titanium compound used in the surface treatment of the N type semi-conductive fine particles include a metal alkoxy compound such as tetrapropoxy titanium, tetrabutoxy titanium, or a metal chelate compound such as diisopropoxytitanium bis(acetylacetate), diisopropoxytitanium bis(ethylacetoacetate), diisopropoxytitanium bis(lactate), dibutoxytitanium bis(octyleneglycolate), or diisopropoxytitanium bis(triethanolaminate). Examples of the reactive organic zirconium compound include a metal alkoxy compound or a metal chelate compound such as tetrabutoxyzirconium or butoxyzirconium triacetylacetate.

Next, constitution of the intermediate layer containing the N type semi-conductive fine particles (hereinafter referred to also as surface-treated N type semi-conductive fine particles) such as titanium oxide particles (hereinafter referred to also as surface-treated titanium oxide particles), which have been subjected to the surface treatment as describe above, will be explained.

The intermediate layer of the invention is formed by coating on a conductive support a dispersion solution in which the surface-treated N type semi-conductive fine particles such as surface-treated titanium oxide particles and a binder are dispersed in a solvent.

The intermediate layer in the invention, which is provided between a conductive support and a photoreceptive layer, improves its adhesion to the support and the photoreceptive layer, and functions as a barrier for preventing charge incorporation from the support. The binder resins used in the intermediate layer include a polyamide resin, a vinyl chloride resin, a vinyl acetate resin, a polyvinyl acetal resin, a polyvinyl butyral resin, polyvinyl alcohol, a melamine resin, an epoxy resin, an alkyd resin, and copolymers having two or more kinds of the repeating unit contained in these resins. Of these binder resins, a polyamide resin is especially preferable.

The amount of surface-treated N type semi-conductive fine particles dispersed in the binder resin, for example in the case of the surface-treated titanium oxide, is 10 to 10,000 parts by weight, and preferably 50 to 1,000 parts by weight based on 100 parts by weight of the binder resin. Usage of the surface-treated titanium oxide in the amount as described above can provide good dispersion stability of the titanium oxide and an improved intermediate layer which does not produce black spots.

The thickness of the intermediate layer in the invention is preferably 0.5 to 15 $\mu$m. The thickness as described above of the intermediate layer can provide an intermediate layer with good electrophotographic properties, which does not produce black spots.

A coating solution for forming the intermediate layer in the invention is comprised of the surface-treated N type semi-conductive fine particles such as the surface-treated titanium oxide described above, a binder resin and a solvent for dispersion. As the solvent for dispersion, a solvent used for forming another photoreceptive layer is used.

The solvents or dispersion media used for forming the intermediate layer, the photoreceptive layer and another resin layer in the invention include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide and methylcellosolve.

The solvents of the intermediate layer are not limited thereto, but methanol, butanol, 1-propanol and isopropanol are preferably used. The solvents described above may be used singly or in combination of two or more kinds.

The coating solvent for the intermediate layer is preferably a mixture solvent of methanol and a straight-chained alcohol. Methanol is a solvent having a high solubility to a resin, and prevents unevenness of the coated layer. Regarding a mixture ratio of the mixture solvent, the straight-chained alcohol content by volume is 0.05 to 0.6 based on 1 of methanol. The solvent mixture prevents image defects occurring due to coating unevenness, since a vaporizing speed of the solvent is suitably maintained in coating.

As a dispersion method of the surface-treated titanium oxide used for preparing a coating solution for an intermediate layer, any dispersion method, for example, a sand-mill method, a ball-mill method or an ultrasonic method may be used.

The coating methods for manufacturing the photoreceptor of the invention including the intermediate layer include a dip-coating method, a spray coating method, and a circular amount control type coating method. In order to minimize dissolution of a lower film resulting from coating of an upper layer, or to form a uniform coating layer, a coating method such as a spray coating method or a circular amount control type coating method (typically, a slide hopper type) is preferably used. The spray coating method is detailed, for example, in Japanese Patent O.P.I. Publication Nos. 3-90250 and 3-269238, and the circular amount control type coating method, for example, in Japanese Patent O.P.I. Publication No. 58-189061.

Constitution of the photoreceptor preferably used in the invention will be explained below.

Conductive Support

The conductive support used in the photoreceptor of the invention may be sheet-like or cylindrical. In order to obtain a compact image forming apparatus, a cylindrical conductive support is preferable.

The cylindrical conductive support in the invention means a cylindrical support necessary to endlessly form an image by rotation. It is preferred that the cylindrical conductive support has a straightness of not more than 0.1 mm, and a diameter deviation of not more than 0.1 mm. The support falling outside the range of the straightness and deviation as described above is difficult to form a good image.

Conductive supports include a metal drum such as aluminum or nickel, a plastic drum onto which aluminum, tin oxide or indium oxide is evaporated, or a paper or plastic drum on which a conductive film is provided. It is preferred that the conductive support has a specific resistance of not more than $10^3$ Ωcm at ordinary temperature.

A layer structure of the preferred photoreceptive layer in the photoreceptor of the invention will be explained below.

Photoreceptive Layer

The photoreceptive layer in the photoreceptor of the invention may be a single layer having both charge generating function and charge transporting function, which is provided on the subbing layer as described above. It is preferred that the photoreceptive layer has a layer structure in which a charge generating function and a charge transporting function are separately assigned to a charge generating layer (CGL) and a charge transporting layer (CTL), respectively. The layer structure, which is function-separated as described above, can control to reduce the increase of residual potential during repeated usage, and makes it easy to control other electrophotographic properties according to the intended object. In photoreceptors for negative charge, a layer structure is preferred in which a charge generating layer is provided on the subbing layer and a charge transporting layer is provided on the charge generating layer. Photoreceptors for positive charge have a layer structure in which the charge generating layer and the charge transporting layer are interchanged in the layer structure as described above for negative charge. The most preferable photoreceptive layer structure in the invention is the layer structure of the photoreceptor for negative charge which is function-separated, as described above.

The layer structure of the photoreceptor for negative charge of function-separated type will be explained below.

Charge Generating Layer

The charge generating layer contains one or more kinds of a charge generating material (CGM), and optionally contains a binder resin or an additive as another substance.

Examples of the charge generating materials (CGM) include well-known charge generating materials (CGM), for example, phthalocyanine pigment, azo pigment, perylene pigment or azulenium pigment. Of these, CGM, which can reduce most residual potential increase at repeated use, is a material having a steric or potential structure capable of forming a stable aggregated structure between the plural molecules, and is typically phthalocyanine pigment or perylene pigment having a specific crystalline structure. For example, CGM such as titanyl phthalocyanine having maximum peak at 27.2° of Bragg angle 2θto Cu—Kα rays or benzimidazole perylene having maximum peak at 12.4° of the Bragg angle 2θ, can reduce residual potential increase without deterioration due to repeated use.

When a binder resin is used in the charge generating layer as a dispersion medium of CGM, well-known binder resins can be used. The most preferable resins include a formal resin, a butyral resin, a silicone resin, a silicone modified butyral resin, and a phenoxy resin. With respect to the content ratio of binder resin to charge generating material, the charge generating material content is preferably 20 to 600 parts by weight based on 100 parts by weight of the resin. These resins can minimize residual potential increase at repeated use. The thickness of the charge generating layer is preferably 0.01 to 2 μm.

Charge Transporting Layer

The charge transporting layer contains a charge transporting material (CTM) and a binder resin for layer forming in which CTM is dispersed, and optionally contains an additive such as an anti-oxidant as another substance.

Examples of the charge transporting materials (CTM) include well-known charge transporting materials (CTM), for example, triphenylamine derivatives, hydrazone compounds, styryl compounds, benzidine compounds, or butadiene compounds. These charge transporting materials are dispersed in an appropriate binder resin for forming a layer. Of these, CGM, which can reduce most residual potential increase at repeated use, is a material having high mobility of 10-5 $cm^2/V\cdot sec$ or more and an ionization potential that the ionization potential difference between CGM used and the material is preferably not more than 0.5 (eV), and more preferably not more than 0.25 (eV).

Ionization potential of CGM or CTL is measured through surface analyzer AC-1 (produced by Rikenkeiki Co., Ltd.).

The resins used in the charge transporting material (CTL) include, for example, polystyrene, an acryl resin, a methacryl resin, a vinyl chloride resin, a vinyl acetate resin, polyvinyl butyral, an epoxy resin, a phenol resin, a polyester resin, an alkyd resin, a polycarbonate resin, a silicone resin, a melamine resin, and copolymers having two or more kinds of the repeating unit contained in these resins. In addition to these insulating resins, there are polymer organic semiconductors such as poly (N-vinylcarbazole).

Of these binder resins for CTL, the most preferable is a polycarbonate resin. The polycarbonate resin is most preferable in improving dispersibility and electrophotographic properties of CTM. With respect to the content ratio of binder resin to charge transporting material, the charge transporting material content is preferably 10 to 200 parts by weight based on 100 parts by weight of the resin. The thickness of the charge transporting layer is preferably 10 to 40 μm.

The most preferable layer structure is exemplified above, but the invention may be a layer structure other than one described above.

FIG. 1 shows a sectional view of one embodiment of the image forming apparatus employing the image forming method of the invention.

In FIG. 1, number 50 shows an image carrier, a photoreceptor drum (photoreceptor), which is obtained by providing an organic photoreceptive layer on a drum, and further providing the resin layer in the invention on the resulting photoreceptive layer, and which is grounded and rotated clockwise for driving. Number 52 shows a charging means of scorotron. The surface of the photoreceptor drum is uniformly charged by corona discharge. In order to eliminate traces resided on the photoreceptor in the prior image forming process, the surface of the photoreceptor, before charged, may be exposed employing pre-exposing means 51, for example, a light emitting diode to eliminate residual charge.

The photoreceptor, after being uniformly charged, is imagewise exposed based on image signals through image exposing means 53. In the image exposing means 53, a laser diode, which is not illustrated, is used as a light source for exposure. The photoreceptor drum is scanned by light, which passes through rotating polygon mirror 531 and fθ lens, and is reflected by reflection mirror 532. Thus, a latent image is formed.

The latent image is developed in developer means 54. The developer means, containing developer comprised of toner and carrier, is provided at the vicinity of photoreceptor drum 50, and development is carried out through rotating developing sleeve 541, containing a magnet, which carries developer. Developing means 54 is composed of developer stirring member 544, developer conveying member 543, and conveying amount controlling member 542. Developer is stirred, conveyed and supplied to the developing sleeve, but its conveying amount is controlled by conveying amount controlling member 542. The conveying amount of the developer differs due to the line speed of the organic electrophotoreceptor used or gravity of the developer used, but is generally in the range of 20 to 200 mg/cm$^2$.

The developer comprises, for example, a carrier, in which the above described ferrite as a core is coated with an insulating resin, and toner, containing colored particles comprised of the above described styrene-acryl type resin as a main component, a colorant such as carbon black, a charge controlling agent and a low molecular weight polyolefin, and an additive such as silica or titanium oxide. Controlled to be a developer layer thickness of 100 to 600 $\mu$m through conveying amount controlling member 542, developer is conveyed to developing sleeve 541, and supplied to developable portions where development is carried out. Development is ordinarily carried out by applying a direct current bias, and optionally an alternating current bias between photoreceptor drum 50 and developing sleeve 541. Development is carried out by contact of the developer with the photoreceptor, or without contact.

After a toner image has been formed, recording paper P is fed to a transfer section by rotation of paper feeding rollers 57 in accordance with transfer timing.

Subsequently, recording paper P is discharged and separated from photoreceptor drum 50 by separating brush (separating means) 59, which is brought into contact with the photoreceptor at the same time as the transferring roller, transported to fixing means 60, wherein heat and pressure are applied through heating roller 601 and pressure roller 602 to fuse the toner, and the paper is then discharged through paper discharging roller 61 outside of the image forming apparatus. After recoding paper P has passed, the above transferring roller 58 and separating brush 59 are separated from photoreceptor 50, and prepared for the next toner image forming process.

Photoreceptor 50, from which recoding paper P has been separated, is brought into contact with cleaning blade 621 of cleaning means 62 and cleaned by eliminating residual toner on it. After that, photoreceptor 50 is subjected to potential elimination by pre-exposing means 51 and charging treatment by charging means 52, and then to the next image formation processing.

Number 70 shows a processing cartridge, capable of being mounted on the image forming apparatus and dismounted, in which photoreceptor, charging means, exposing means, transferring means, separating means, and cleaning means are integrated.

The organic electrophotoreceptor of the invention is applied to conventional electrophotographic apparatuses such as an electrophotographic copier, a laser printer, an LED printer, and a liquid crystal shutter type printer, and can be also applied to apparatuses such as displays, recorders, printing machines, film-making apparatuses, and facsimiles each employing electrophotographic techniques.

EXAMPLES

Next, the invention will be detailed according to the following examples, but is not limited thereto. The term "parts" is parts by weight, unless otherwise specified.

Preparation of Intermediate Layer Coating Solution

Preparation of Intermediate Layer Coating Solution 1

One part by weight of polyamide resin CM8000 (produced by Toray Co. Ltd.), 3 parts by weight of titanium oxide SMT 500SAS (produced by Teika Co., Ltd., subjected to the first surface treatment by silica-alumina, and the second surface treatment by methyl hydrogen polysiloxane), and 10 parts by weight of methanol were incorporated in a vessel and dispersed through an ultrasonic homogenizer to obtain coating solution 1 of the inventive example.

(Preparation of Inventive Intermediate Layer Coating Solutions 2 through 16)

Inventive intermediate layer coating solutions 2–16 were prepared using the same procedures as in intermediate layer coating solution 1 , except that titanium oxide, its particle size, surface treatments, kinds of binder resin, titanium oxide/binder resin content ratio by weight, and solvents were changed to those as shown in Table 1. Thus, inventive intermediate layer coating solutions 2 to 16 were obtained.

(Preparation of Inventive Intermediate Layer Coating Solution 17)

Inventive intermediate layer coating solution 17 was prepared in the same manner as in inventive intermediate layer coating solution 1, except that the second surface treatment of titanium oxide MT500SA was carried out employing diisopropoxytitanium (acetylacetate). Inventive intermediate layer coating solution 17 contained titanium oxide particles A.

(Preparation of Inventive Intermediate Layer Coating Solution 18)

Inventive intermediate layer coating solution 18 was prepared in the same manner as in intermediate layer coating solution 1, except that the second surface treatment of titanium oxide MT500SA was carried out employing butoxyzirconium tri(acetylacetate). Inventive intermediate layer coating solution 18 contained titanium oxide particles B.

(Preparation of Comparative Intermediate Layer Coating Solutions 1 through 3)

The same procedures as in inventive intermediate layer coating solution 1 were carried out, except that titanium oxide, its particle size, surface treatments, kinds of binder resin, titanium oxide/binder resin content ratio by weight, and solvents were changed to those as shown in Table 1. Thus, comparative intermediate layer coating solutions 1 to 3 were obtained.

(Preparation of Comparative Intermediate Layer Coating Solution 4)

One part by weight of polyamide resin CM 8000 (produced by Toray Co. Ltd.), and 10 parts by weight of methanol were incorporated in a vessel and dissolved to obtain comparative intermediate layer coating solution 4.

In Table 1, substances described in the "first surface treatment" column show compounds precipitated on the surface of titanium oxide (N type semi-conductive fine particles) after the first surface treatment, and substances described in the "second surface treatment" column show compounds employed in the second surface treatment. Further, the numeral indicated with (%) in the column of second treatment in the table means (weight %) of the compounds used in the second treatment for the titanium oxide before the first treatment.

TABLE 1

| Intermediate layer coating solution No. | Kinds of titanium oxide (N type semi-conductive fine particles) Trade name (Maker) | First surface treatment | Second surface treatment | Number average primary order particle size (nm) | Polyamide binder resin (Maker) | Content ratio by weight of titanium oxide to binder resin | Kinds of solvents used (mixture ratio) |
|---|---|---|---|---|---|---|---|
| 1 (Inv.) | SMT500SAS*1 | silica · alumina | methyl hydrogen polysiloxane | 35 | CM8000* | 3/1 | methanol |
| 2 (Inv.) | MT500SA*1 surface-treated by phenylsilane | silica · alumina | trimethoxyphenyl silane 5% | 35 | CM8000* | 3/1 | methanol |
| 3 (Inv.) | MT500HS*1 | alumina | methyl hydrogen polysiloxane | 35 | CM8000* | 2.5/1 | methanol |
| 4 (Inv.) | MT500SA*1 surface-treated by octylsilane | silica · alumina | trimethoxyoctyl silane | 35 | CM8000* | 3/1 | methanol/ n-butanol (3/1) |
| 5 (Inv.) | ST-495MA*2 surface-treated by hexylsilane | silica · alumina | trimethoxyhexyl silane 5% | 170 | CM8000* | 3/1 | methanol/ n-butanol (3/1) |
| 6 (Inv.) | STT-65SAS | silica · alumina | methyl hydrogen polysiloxane | 50 | CM8000* | 3.5/1 | methanol |
| 7 (Inv.) | STT-30AFS | alumina | fluorinated silane | 30 | CM8000* | 2/1 | methanol |
| 8 (Inv.) | ST-480A | silica · alumina | trimethoxyisobutyl silane 5% | 50 | CM8000* | 4/1 | methanol/ n-butanol (3/1) |
| 9 (Inv.) | SMT100SAS | silica · alumina | methyl hydrogen polysiloxane | 15 | CM8000* | 3/1 | methanol |
| 10 (Inv.) | MT500B surface treated by fluorinated silane | fluorinated silane | none | 35 | CM8000* | 3/1 | methanol |
| 11 (Inv.) | UMT500SAX*1 | silica · alumina | trimethoxyhexyl silane 5% | CM8000* | 35 | 3/1 | methanol/ n-propanol (65/35) |
| 12 (Inv.) | UMT500SAX*1 | silica · alumina | trimethoxyhexyl silane 10% | 35 | CM8000* | 3/1 | methanol/ n-propanol (65/35) |
| 13 (Inv.) | UMT500SAX*1 | silica · alumina | trimethoxyhexyl silane 15% | 35 | CM8000* | 3/1 | methanol/ n-propanol (65/35) |
| 14 (Inv.) | MT500SA surface-treated by methylsilane*1 | silica · alumina | trimethoxymethyl silane 5% | 35 | Lackamide 5003** | 4/1 | methanol/ n-propanol (4/1) |
| 15 (Inv.) | MT500SA surface-treated by butylsilane*1 | silica · alumina | trimethoxybutyl silane 5% | 35 | Lackamide 5003** | 4/1 | methanol/ n-propanol (4/1) |
| 16 (Inv.) | UNT500SAX*1 | silica · alumina | trimethoxyhexyl silane 5% | 35 | M6401-50: G821-60** | 3/1 | methylethyl ketone |
| 17 (Inv.) | Titanium dioxide particles A*4 | silica · alumina | diisopropoxy titanium bis (acecylacetate) | 35 | CM8000* | 3/1 | methanol |
| 18 (Inv.) | Titanium dioxide particles B*5 | silica · alumina | butoxyzirconium bis (acecylacetate) | 35 | CM8000* | 3/1 | methanol |
| 1 (Comp.) | MT500B*1 | none | none | 35 | CM8000* | 3/1 | methanol |
| 2 (Comp.) | MT500B surface-treated by methyl hydrogen polysiloxane*1 | methyl hydrogen polysiloxane | none | 35 | CM8000* | 3/1 | methanol |
| 3 (Comp.) | TTO55S*3 | alumina | dimethyl polysiloxane | 50 | CM8000* | 3/1 | methanol |
| 4 (Comp.) | none | none | none | none | CM8000* | 3/1 | methanol |

Inv.: Invention, Comp.: Comparative

The binder resin used in sample No. 16 (Inv.) is alkyd melamine resin produced by Dainippon Ink Co., Ltd.

*1(produced by Teika Co., Ltd.)

*2(produced by Titan Kogyo Co., Ltd.)

*3(produced by Ishihara Sangyo Co., Ltd.)

*4Titanium dioxide particles A is MT500SA (produced by Teika Co., Ltd.) subjected to second surface treatment by diisopropoxytitanium-bis (acetylacetate).

*5Titanium dioxide particles B is MT500SA (produced by Teika Co., Ltd.) subjected to second surface treatment by butoxyzirconiumtri (acetylacetate).

*(produced by Toray Co., Ltd.)

**(produced by Dainippon Ink Co., Ltd.)

Example 1

A cylindrical aluminum support was dip-coated with intermediate layer coating solution 1 to form an intermediate layer with a dry thickness of 4 μm. A dispersion solution, in which 2 part of titanyl phthalocyanine having maximum peak at 27.2° in an X-ray diffraction spectrum (Bragg angle 2θ±0.2°) of a Cu—Kα ray, and 1 part of butyral resin were dispersed in 70 parts of tert-butyl acetate and 30 parts of 4-methoxy-4-methyl-2-pentanone employing a sand mill, was dip-coated on the resulting intermediate layer to form a charge generating layer with a dry thickness of about 0.3 μm. Subsequently, a solution, in which 0.65 parts of a charge transporting agent (compound A) and 1 part of polycarbonate resin Yupilon-Z200 (produced by Mitsubishi Gas Chemical Co., Ltd.) were dissolved in 7.5 parts of dichloroethane, was dip-coated on the resulting charge generating layer to form a charge transporting layer with a dry thickness of about 24 μm, and dried at 1000° C. for 70 minutes. Thus, electrophotoreceptor 1 of the inventive example was obtained.

Compound A

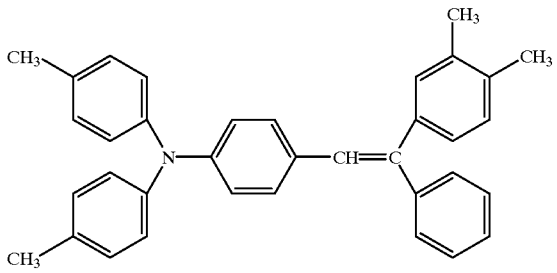

Examples 2 through 18

Electrophotoreceptor 2 through 18 were prepared in the same manner as in Example 1 above, except that intermediate layer coating solutions as shown in Table 3 were used instead of intermediate layer coating solution 1 and the dry thickness of the intermediate layer was changed as shown in Table 3.

Comparative Examples 1 through 4

Comparative electrophotoreceptor 1 through 4 of the comparative example were prepared in the same manner as in Example 1 above, except that intermediate layer coating solutions as shown in Table 3 were used instead of intermediate layer coating solution 1 and the dry thickness of the intermediate layer was changed as shown in Table 3.

Comparative Example 5

Comparative electrophotoreceptor 15 was prepared in the same manner as in Example 1 above, except that the intermediate layer was not provided.

Evaluation 1 (Evaluation of Dispersion Stability)

Intermediate layer coating solutions 1 through 13 used in Examples 1 through 18 and Comparative examples 1 through 4 were placed in a glass beaker, allowed to stand for two days, and evaluated for sedimentation of the titanium oxide.

The sedimentation was observed visually, and evaluated according to the following criteria:

A: No sedimentation was observed.

B: A slight sedimentation was observed.

C: The titanium oxide was separated from the solvent and precipitated.

The results are shown in Table 2.

Evaluation 2

Each of the electrophotoreceptor samples obtained above was mounted on a Konica 7050 modified copier (equipped with scorotron, laser for exposing, LED for charge elimination), and charging, exposure, and charge elimination were continuously repeated 6,000 cycles under normal condition (19° C. and 30%RH), under condition of high temperature and high humidity (30° C. and 83%RH), or under condition of low temperature and low humidity (7° C. and 21%RH). The potential at exposed portions was measured at first cycle and at the last cycle. Difference between the maximum potential and minimum potential at laser exposed portions was computed under each condition, and is shown as VL condition difference (ΔVL) in Table 2.

Evaluation 3

In order to evaluate image properties of an image formed under normal condition (NN; 19° C. and 30%RH), under condition of high temperature and high humidity (HH; 30° C. and 83%RH), or under condition of low temperature and low humidity (LL; 7° C. and 21%RH), the following accelerated test was carried out.

Each of the electrophotoreceptor samples obtained above was mounted on a Konica 7050 copier (employing scorotron charger, laser exposure, reversal development, static transfer, claw separation, and cleaning blade). Grid voltage of the scorotron charger being set to be −1,000 V, and developing bias at the reversal development to be −800V, copying of 6,000 cycles was carried out under each condition above, employing paper of A4 size. Black spot image defects were observed at the first copy and the final copy. The permissible line is A and B indicated below. The results are shown in Table 2.

Evaluation Criteria:

A: No black spot image defects were observed under NN, HH, and LL conditions.

B: Black spot image defects were observed under one of NN, HH, and LL conditions.

C: Black spot image defects were observed under two or more of NN, HH, and LL conditions.

Evaluation 4

Unevenness at half-tone portions was evaluated employing a gray chart. The evaluation criteria are as follows:

A: No unevenness

B: slight unevenness is observed, but not problematic for practical use.

C: Unevenness occurs, and problematic for practical use.

Ratings A and B are Acceptable.

The results are shown in Table 2.

TABLE 2

| | Inter-mediate layer coating solution No. | Inter-mediate layer thickness (μm) | Dispersion stability of coating solution | Potential difference ΔVL (V) | Image evaluation Black spots | Image evaluation Unevenness |
|---|---|---|---|---|---|---|
| Example 1 | Inventive coating solution 1 | 4 | A | 47 | A | A |
| Example 2 | Inventive coating solution 2 | 3 | A | 25 | A | B |
| Example 3 | Inventive coating solution 3 | 5 | B | 37 | A | B |
| Example 4 | Inventive coating solution 4 | 2 | A | 8 | A | B |
| Example 5 | Inventive coating solution 5 | 3 | A | 12 | A | A |
| Example 6 | Inventive coating solution 6 | 2 | A | 49 | A | B |
| Example 7 | Inventive coating solution 7 | 3 | A | 63 | A | B |
| Example 8 | Inventive coating solution 8 | 4 | B | 17 | A | A |
| Example 9 | Inventive coating solution 9 | 3 | A | 33 | A | B |
| Example 10 | Inventive coating solution 10 | 3 | A | 47 | A | B |
| Example 11 | Inventive coating solution 11 | 5 | B | 26 | A | A |
| Example 12 | Inventive coating solution 12 | 5 | A | 22 | A | A |
| Example 13 | Inventive coating solution 13 | 5 | A | 58 | A | A |
| Example 14 | Inventive coating solution 14 | 4 | B | 36 | A | B |
| Example 15 | Inventive coating solution 15 | 4 | A | 59 | A | A |
| Example 16 | Inventive coating solution 16 | 6 | A | 45 | A | A |
| Example 17 | Inventive coating solution 17 | 4 | A | 44 | A | B |
| Example 18 | Inventive coating solution 18 | 4 | A | 56 | A | B |
| Comparative example 1 | Comparative coating solution 1 | 4 | C | 35 | C | C |
| Comparative example 2 | Comparative coating solution 2 | 3 | C | 127 | C | C |
| Comparative example 3 | Comparative coating solution 3 | 5 | C | 236 | B | C |
| Comparative example 4 | Comparative 2 coating solution 4 | 2 | — | 349 | C | C |
| Comparative example 5 | None | — | — | 25 | C | C |

As is apparent from Table 2 above, the electrophotoreceptor of the invention, comprising an intermediate layer containing titanium oxide particles subjected to plural surface treatments comprising the final surface treatment carried out employing a reactive silicon compound, or titanium oxide particles surface-treated employing a fluorine-containing silicon compound, minimized black spot occurrence at reversal development, without jeopardizing the electric properties. On the other hand, electrophotoreceptors (comparative examples 1 through 4), comprising an intermediate layer containing titanium oxide particles subjected to surface treatments falling outside the scope of the invention or containing no titanium oxide particles, increased potential at exposed portions, or produced black spot image defects. Regarding the N type semi-conductive fine particles other than titanium oxide particles, the same procedures and evaluations as in titanium oxide particles were carried out, and the excellent results of the invention were obtained.

As is apparent from the above examples, the present invention solves the problems as follows:

1) sensitivity variation is small under conditions of from high temperature and high humidity to low temperature and low humidity.
2) Image defects such as black spots are not produced.
3) Stability of the intermediate layer coating solutions is excellent.

What is claimed is:

1. An electrophotoreceptor, comprising, a conductive support;

a photoreceptive layer, an intermediate layer provided between the conductive support and the photoreceptive layer, the intermediate layer containing N type semi-conductive fine particles and a binder resin, wherein the N type semi-conductive fine particles are subjected to plural surface treatments with silica and alumina, and a final surface treatment is carried out employing methyl hydrogen polysiloxane.

2. The electrophotoreceptor of claim 1, wherein the N type semi-conductive fine particles are titanium oxide particles.

3. The electrophotoreceptor of claim 1, wherein the N type semi-conductive fine particles have a crystal structure of rutile.

4. The electrophotoreceptor of claim 1, wherein the binder resin in the intermediate layer is polyamide resin.

5. The electrophotoreceptor of claim 1, wherein the N type semi-conductive fine particles have a number average primary order particle size of 10 to 200 nm.

* * * * *